United States Patent [19]

Klimke et al.

[11] Patent Number: 4,998,306

[45] Date of Patent: Mar. 12, 1991

[54] BUILT-IN SINK

[75] Inventors: Peter Klimke; Paul Neubert, both of Gross-Umstadt, Fed. Rep. of Germany

[73] Assignee: Resopal GmbH, Gross-Umstadt, Fed. Rep. of Germany

[21] Appl. No.: 386,774

[22] Filed: Jul. 31, 1989

[30] Foreign Application Priority Data

Feb. 11, 1989 [DE] Fed. Rep. of Germany ..... 3904121

[51] Int. Cl.[5] ..... A47K 1/04; A47K 1/12

[52] U.S. Cl. ..... 4/619; 4/638; 4/639; 4/631

[58] Field of Search ..... 4/619, 631, 630, 637, 4/638, 639, 640

[56] References Cited

U.S. PATENT DOCUMENTS

| | | | |
|---|---|---|---|
| 1,937,311 | 11/1933 | Brotz | 4/640 |
| 2,194,343 | 3/1940 | Wexler | 4/637 |
| 2,588,464 | 3/1952 | Bargman | 4/637 |

*Primary Examiner*—Henry J. Recla
*Assistant Examiner*—David J. Walczak
*Attorney, Agent, or Firm*—Burns, Doane, Swecker & Mathis

[57] ABSTRACT

A built-in sink comprises separate modules, for example, a sink basin and a drainboard, positively connected with each other. Each module is provided with a joining flange, the flanges being held together by a connecting strip. The modules contain overflow spouts along the common edge therebetween. The spouts face one another and empty into a common drain disposed therebelow.

7 Claims, 3 Drawing Sheets

BUILT-IN SINK

BACKGROUND OF THE INVENTION

The invention concerns a built-in sink comprising at least two combined sink parts, of which at least one is a flush basin with an overflow provided on the basin wall.

Built-in sinks, set into cut-outs of countertops, usually are in the form of a combination of a sink with a draining part. However, other combinations are also used. All of these known built-in sink combinations have in common that they comprise a single prefabricated part. The materials used are stainless steel sheet, plastic, enameled sheet steel, ceramics and the like.

Because of their dimensions, these known built-in sinks require a relatively high production effort. For example, in the production of prefabricated sinks made of a plastic very large injection molding tools must be used, with every different type of combination, requiring a separate, large and thus expensive, injection molding tool.

The necessarily large dimensions of the known built-in sinks render their transportation, storage and installation difficult. If the built-in sink becomes damaged, repair costs are high, because in each case the entire unit must be replaced.

It is, therefore, an object of the invention to design a built-in sink of the above-mentioned type so that numerous combinations of sink parts are possible with a lower cost of production, transportation, inventory storage and installation.

This object is attained according to the invention, that the sink including a shallow basin, a drainboard and/or another sink basin, is in the form of separate sink modules connected positively with each other.

This modular configuration results in a significant simplification of production, transportation, inventory maintenance and installation, as the dimensions of the individual sink modules are substantially smaller than the built-in sink assemblies from them. The assembly of the combination desired is carried out only during installation of the sink in a countertop. The tools required for the manufacture of the individual parts of the sink, in particular injection molding tools in the case of plastics, are significantly smaller and thus less expensive than in the manufacture of simple-part built-in sinks.

By the positive joining of the combined sink modules a necessarily accurate alignment of the individual sink modules is obtained, which makes possible efficient sealing between the sink modules by simple means.

According to a preferred embodiment of the invention, the sink modules joined together are provided at their connecting edges with a joining flange and the adjacent, parallel joining flanges are covered by a connecting strip positively engaging the flanges. The connecting strip not only provides an optically pleasing transition between adjacent sink modules, but by its positive joining effect assures a secure connection and mutual alignment.

The connecting strip is preferably fastened by being screwed to a counter strip located under the joining flanges. In this manner the two adjacent joining flanges are held together fixedly and securely even without an attachment to the work surface, while simultaneously sealing the area involved.

According to a particularly advantageous configuration, the counter strip is provided at its center with a drain with which the overflows of the two adjacent sink modules communicate. In this manner, an overflow, which is hardly noticeable optically, is created for the two adjacent sink modules. The overflow may be installed very simply since the drain comprises an integral part of the counter strip which is being held against the undersides of the two joining flanges and is screwed to the connected strip located thereabove. The establishment of the connection between two adjacent sink modules by means of the connecting strip and the counter strip simultaneously completes the installation of the drain for the overflow from two adjacent sink modules. In contrast to known configurations, there are no openings in the side wall of the bowl and drainage lines that must be tiqhtly connected with the openings.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
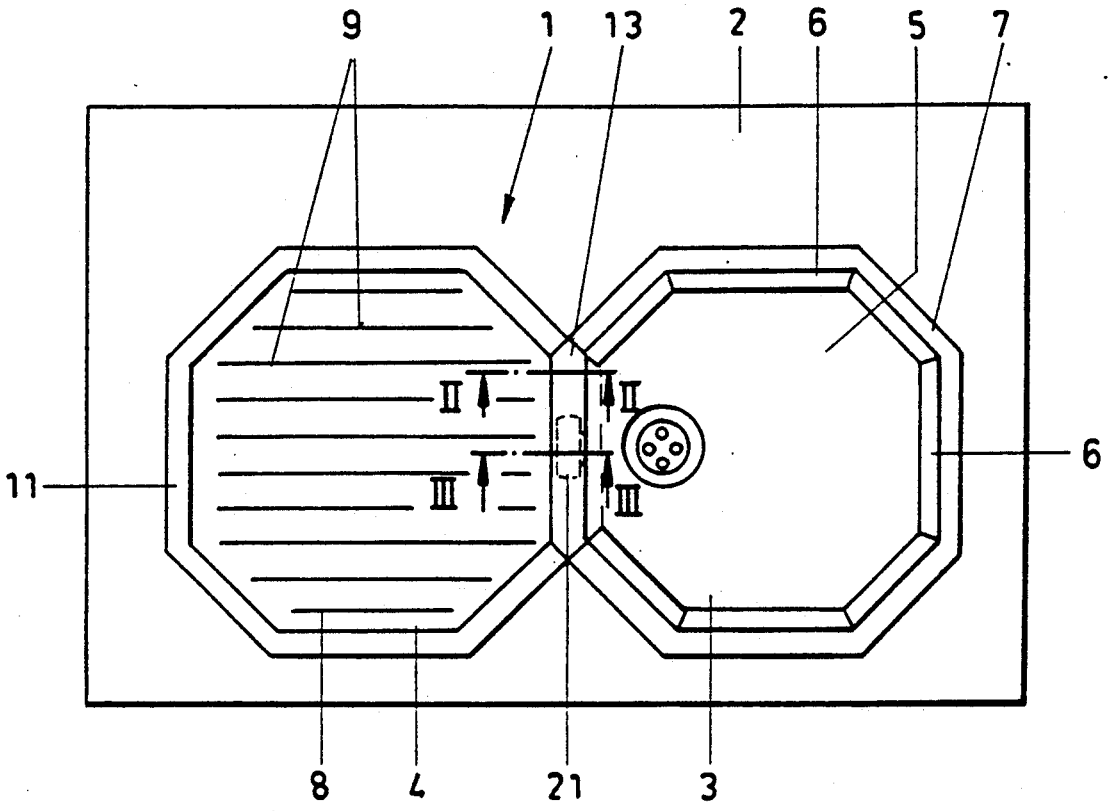
FIG. 1 is a top plan view of a built-in sink assembly according to the present invention.

The built-in sink assembly 1, made of a plastic, shown in FIG. 1, is built into a work surface 2. In the embodiment shown the built-in sink assembly 1 is a combination of a sink basin 3 with a drain board 4 in the form of a shallow basin, both parts having the configuration of a polygon, preferably an octagonal module in top plan view.

The sink basin 3 has a bottom 5, from which side walls 6 are extending upward to a horizontal edge flange 7, resting on the edge of the cut-out in the work surface 2.

The drain board 4 also has a bottom 8, on which traverse ribs 9 are located. From the edge of the bottom 8 a short wall strip 10 extends to horizontal edge flanges 11, which also are resting on the edge of the work surface 2.

Figure 2:
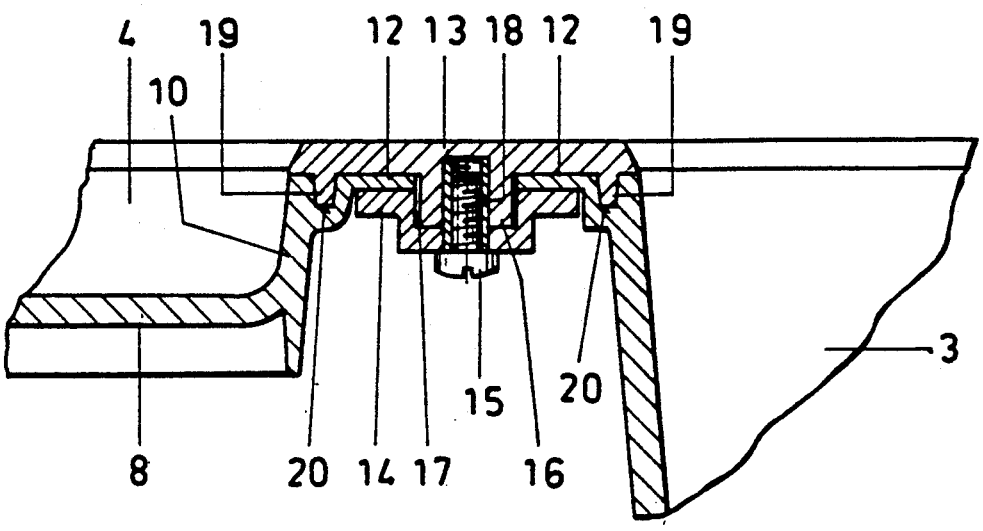
FIG. 2 is a sectional view taken along the line II—II in FIG. 1.
Figure 4:
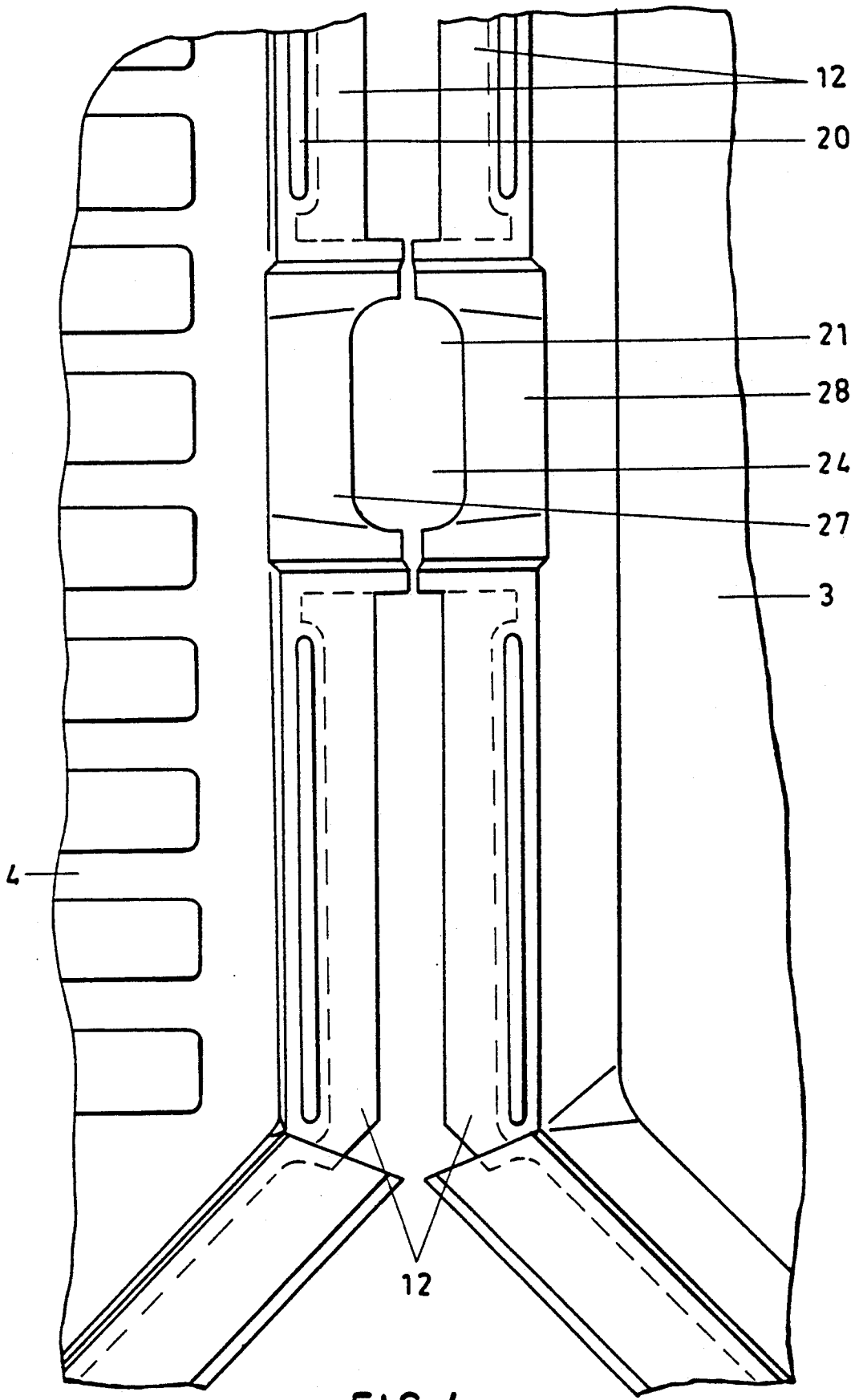
FIG. 4 is a fragmentary top plan view of a common edge between the modules, with the connecting strip and counter strip removed.

At their connecting edge, the two sink modules, i.e., the sink basin 3 and the drain board 4, are each provided with a horizontally projecting joining flange 12 (FIGS. 2 and 4), both flanges extending parallel to and paced spaced apart from each other, at the same height. A common connecting strip 13 is resting on the joining flanges 12 and is connected with a counter strip 14 located under the joining flanges 12 by means of screws 15. The connecting strip 13 includes downwardly projecting studs 16 received in corresponding recesses 17 in the counter strip 14. Cylindrical threaded bushings 18 are set into the studs 16, into which the screws 15 are screwed from below.

The connecting strip 13 has downwardly projecting ribs 19 near its longitudinal edges, the ribs 19 engaging longitudinal grooves 20 in the top sides of the respective joining flanges 12, in a positive and sealing manner. The two adjacent joining flanges 12 are thereby positively connected with each other, so that the two sink modules 3 and 4 form a rigid unit in the assembled state. At the same time, the connecting strip 13 covers the joint between the two sink modules 3 and 4. The connecting strip 13 is located at the same height as the edge flanges 7 and 11 and abuts against them, so that an optically closed appearance is created.

Figure 3:
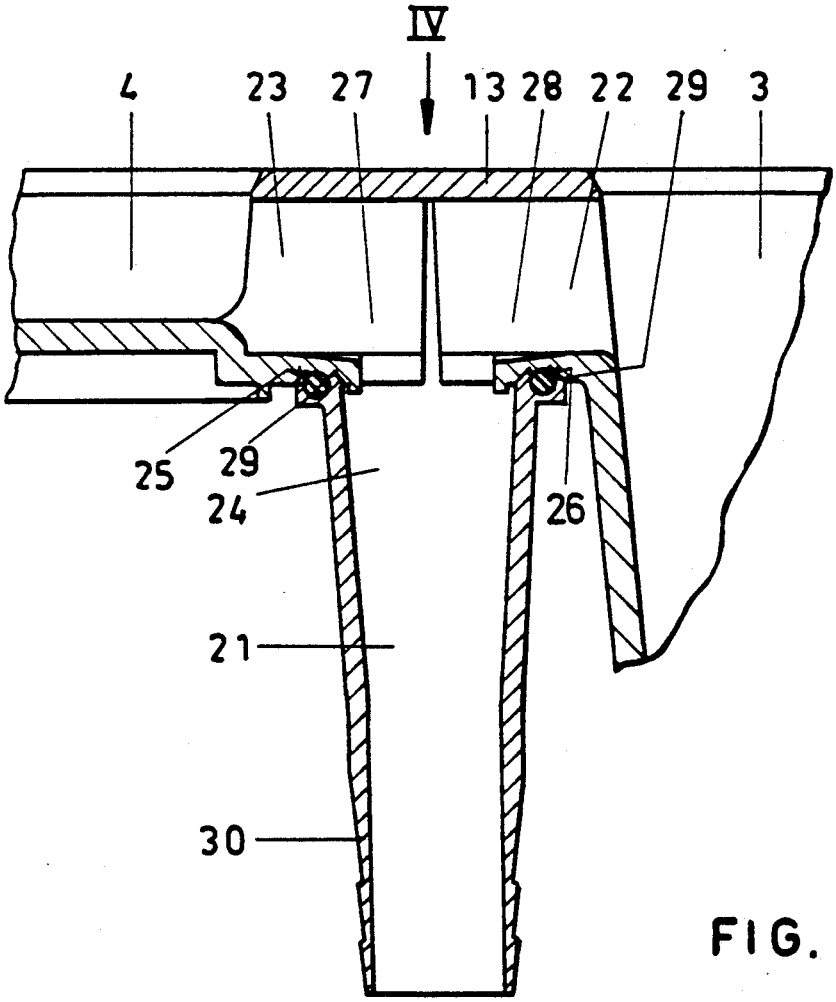
FIG. 3 is a sectional view taken along the line III—III in FIG. 1.

The counter strip 14 includes, at a midpoint thereof, a drain 21 which communicates with overflows 22 and 23 formed in the sink basin 3 and the drain board 4 (FIG. 3). The drain 21 has a drain shaft 24, two opposing sides of which have upper edges disposed in recesses 25 and 26 formed in the undersides of overflow spouts 27, 28. The overflow spout 27 opens into one side of the drain shaft 24. The spout 27 is formed between two sections of the joining flange 12 of the drain board 4, and the overflow spout 28 is provided between two sections of the joining flange 12 of the sink basin 3 (FIG. 4), and opens into the opposite side of the drain shaft 24.

The drain shaft 24 and the two overflow spouts 27 and 28 opening into it are open at their top side and are covered by the connecting strip 13 extending thereacross. Gaskets 29 are inserted into grooves formed in the upper edges of the drainage shaft so as to engage the associated recesses 25 and 26, in order that a tight connection of the two sink modules 3, 4 with the drain 21 is assured. In the joining areas on either side of the drain 21, adequate sealing is provided by the connecting strip 13.

As shown in FIG. 3, the drain shaft 24 forms a drain fitting 30 to which a drain hose or drain pipe is connected.

In place of the sink basin 3 and drainboard 4 shown as an example of the modules that may be combined, other sink parts may be provided and combined with each other in the afore-described manner. It is possible, for example, to combine two sink basins with each other. It is also possible to insert a smaller utility basin between the basin 3 and the drainboard 4, for example for the disposal of food wastes. Three or more sink modules may further be installed in a corner configuration.

Although the present invention has been described in connection with a preferred embodiment thereof, it will be appreciated by those skilled in the art that additions, modifications, substitutions, and deletions not specifically described may be made, without departing from the spirit and scope of the invention, as defined in the appended claims.

What is claimed is:

1. A sink assembly adapted to be built into a counter, comprising a plurality of modules, at least one of said modules comprising a sink basin having a wall with an overflow adjacent an upper end thereof; each of said modules including an upper edge disposed adjacent an upper edge of another of said modules; said overflow located adjacent one of said adjacently disposed edges, each of said adjacently disposed edges including a joining flange; a connecting strip and a counter-strip disposed, respectively, above and below said joining flanges; connecting means interconnecting said connecting strip and said counter-strip in a manner sandwiching said joining flanges therebetween for securing together said adjacently disposed edges, said counter-strip including a downwardly extending drain underlying said overflow.

2. A sink assembly according to claim 1, wherein another of said modules comprises an additional sink basin.

3. A sink assembly according to claim 1, wherein another of said modules comprises a drainboard.

4. A sink assembly according to claim 1, wherein each of said modules includes an overflow, said overflows being disposed opposite one another.

5. A sink assembly according to claim 1, wherein each of said modules includes an overflow, said drain underlying each of said overflows.

6. A sink assembly according to claim 5, wherein each of said overflows comprises a spout situated between opposite ends of an associated joining flange, each of said spouts terminating in a discharge edge, said drain comprising a drain shaft underlying both of said discharge edges.

7. A sink assembly according to claim 6, wherein said connecting strip covers said spouts and drain shaft.

* * * * *